United States Patent [19]

Salzmann et al.

[11] Patent Number: 5,054,964

[45] Date of Patent: Oct. 8, 1991

[54] STIFFENING ELEMENT FOR A LATTICE GIRDER

[75] Inventors: / Peter Salzmann, Triengen; Hans Hügi, Schötz, both of Switzerland

[73] Assignee: Pantex-Stahl AG, Buron, Switzerland

[21] Appl. No.: 449,268

[22] Filed: Dec. 12, 1989

[30] Foreign Application Priority Data

Feb. 1, 1989 [CH] Switzerland ..... 342/89

[51] Int. Cl.[5] ..... F04C 3/04

[52] U.S. Cl. ..... 405/288; 405/150; 52/650; 52/694

[58] Field of Search ..... 405/288, 150; 52/655, 52/690, 693, 694

[56] References Cited

U.S. PATENT DOCUMENTS

| | | | |
|---|---|---|---|
| 3,036,676 | 5/1962 | Potzsch | 52/693 |
| 3,381,479 | 5/1968 | Curzio | 405/150 |
| 3,930,349 | 1/1976 | Wellerhaus | 52/694 X |

FOREIGN PATENT DOCUMENTS

| | | | |
|---|---|---|---|
| 73733 | 8/1982 | European Pat. Off. . | |
| 2604743 | 10/1987 | France . | |
| 547410 | 11/1972 | Switzerland | 52/655 |
| 2195677 | 4/1988 | United Kingdom . | |

*Primary Examiner*—Dennis L. Taylor
*Assistant Examiner*—Arlen L. Olsen
*Attorney, Agent, or Firm*—Pollock, Vande Sande & Priddy

[57] ABSTRACT

Stiffening elements are welded between the three rods (T1, T2, T3) of three-rod girders in underground drift construction. Such stiffening elements consist of thee triangular wire polygons (10, 20, 30) connected to form one piece. Two of the polygons meet at the top rod (T3) to form a wire pyramid. The third wire polygon (30) is perpendicular to the plane determined by the axes of the lower rods (T1, T2). Since neither this third wire polygon (30) nor the adjacent polygon (10), which is one side of the pyramid, needs a cross-strut between the lower rods (T1, T2), a significant saving in materials combined with high resistance to bending is achieved.

2 Claims, 1 Drawing Sheet

STIFFENING ELEMENT FOR A LATTICE GIRDER

FIELD OF THE INVENTION

The invention relates to a stiffening element for a lattice girder.

BACKGROUND OF THE INVENTION

In underground drift construction, after preparatory work, arch supports are built in for support of the roof; these arch supports provide access and are set in concrete. Increasing numbers of lattice girders in conjunction with shotcrete are used because, in contrast to I- or U-beams, they eliminate shaded areas behind the girder and therefore a more even layer of concrete is made possible. Such lattice girders are described in EP-B-73733, for example.

Statical evidence from such a lattice girder shows the local cut magnitudes of the individual bars of the girder based on the global cut magnitudes in the total system. The distance between the stiffening elements plays a determinative role in this.

The larger the distance chosen, the more adversely the local loads affect the girder, i.e., the less favorable the transverse loads, the bending moments in the bars, and the compression and tensile loads become, which causes increased stress on the material and can finally necessitate larger lateral section dimensions, which is also uneconomical.

Even more determinative, however, is the fact that the greater the distance between the joints on the individual bar of the frame girder, the more adversely this distance affects the local buckling tendency of such bar.

To improve the load and stability capacities of a lattice girder, the stiffening elements should ideally be relatively close to each other, on the one hand, and the individual rod of the lattice girder should be supported centrally between the joints, on the other hand, so that its buckling length is halved.

An improvement was achieved in an embodiment according to GB-A-2 195 677, which proposed a connecting element in the form of a four-sided pyramid whose tip is secured to the top rod and whose lower ends are connected by cross-struts diagonally to the lower rods. It was proposed that a separate triangularly formed intermediate element be attached perpendicularly to the rods to improve resistance to buckling for such a connecting element. However, such an additional, triangular support element bound to the rods and attached vertically between the stiffening elements produces an accumulation of closely adjacent welding joints.

This is by no means desirable, however, since these closely adjacent welding joints may affect the structure of the steel (and in the worst case may even promote a dangerous martensite formation), which can cause brittleness in the rods and can thereby place the load-bearing capacity of the lattice girder in doubt. In extreme cases the welding joints can break under heavy loads, which leads to displacement of the stiffening elements.

SUMMARY OF THE INVENTION

It is therefore the object of the invention to create a simple, inexpensive stiffening element which enables a reduction by half of the distance between joints in the individual lattice girder rods. At the same time, high inherent stability, i.e., lateral stability, against bending as well as against buckling and torsion are achieved by the pyramid forms of the stiffening elements.

The stiffening element can be made in one piece so that it can be connected to the rods at relatively few welding joints; this reduces brittleness in the material caused by welding.

BRIEF DESCRIPTION OF THE DRAWINGS

An embodiment of the invention will now be described by way of example with reference to the accompanying drawings, wherein.

DESCRIPTION OF PREFERRED EMBODIMENT

Figure 1:
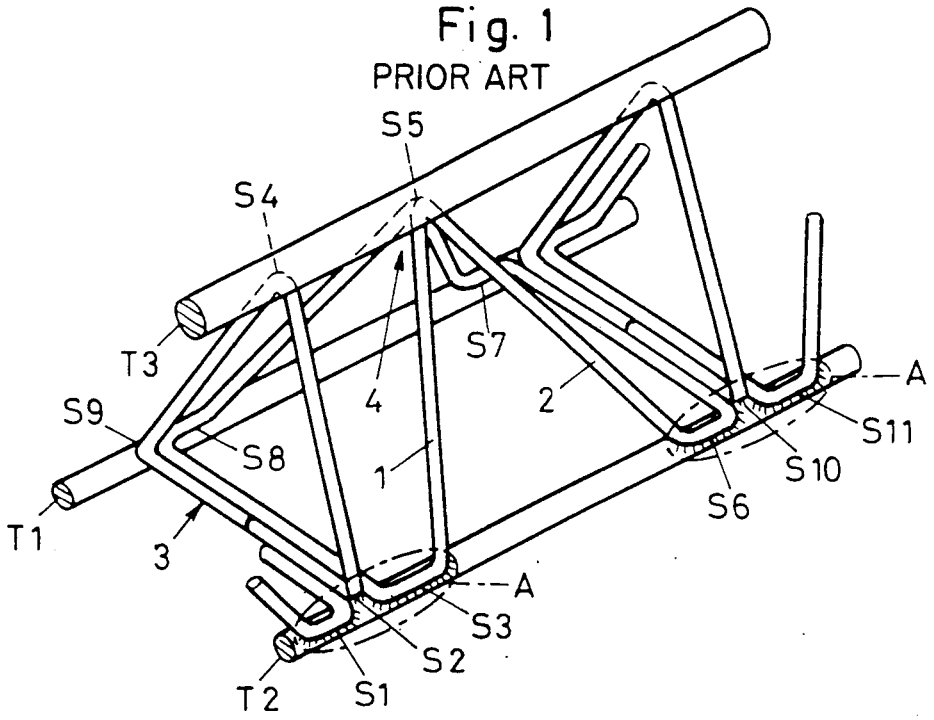
Fig. 1 PRIOR ART
FIG. 1 shows a prior art connecting element corresponding to FIG. 3 of GB-A-2 195 677.

The connecting element in accordance with FIG. 1 consists of two portions 1 and 2, essentially triangular wire polygons, welded to the three rods, the top rod T3 and the two lower rods T1 and T2, respectively at three welding locations S3, S5, S8 and S5, S6 and S7. The welding location S5 on the top rod T3 is shown as a single welding location, although there could easily be two welding locations if there is a greater distance between the two wire polygons 1, 2. A further wire triangle 3 is welded in the two areas A (shown in dot-dash lines) in order to increase the stability of the lattice girder, in addition to the polygons 1, 2. Thus, three welding locations S1, S2, S3, or S6, S10, S11 are repeatedly closely adjacent to each other so that undesirable formation of martensite is promoted, as discussed herein above.

Figure 2:
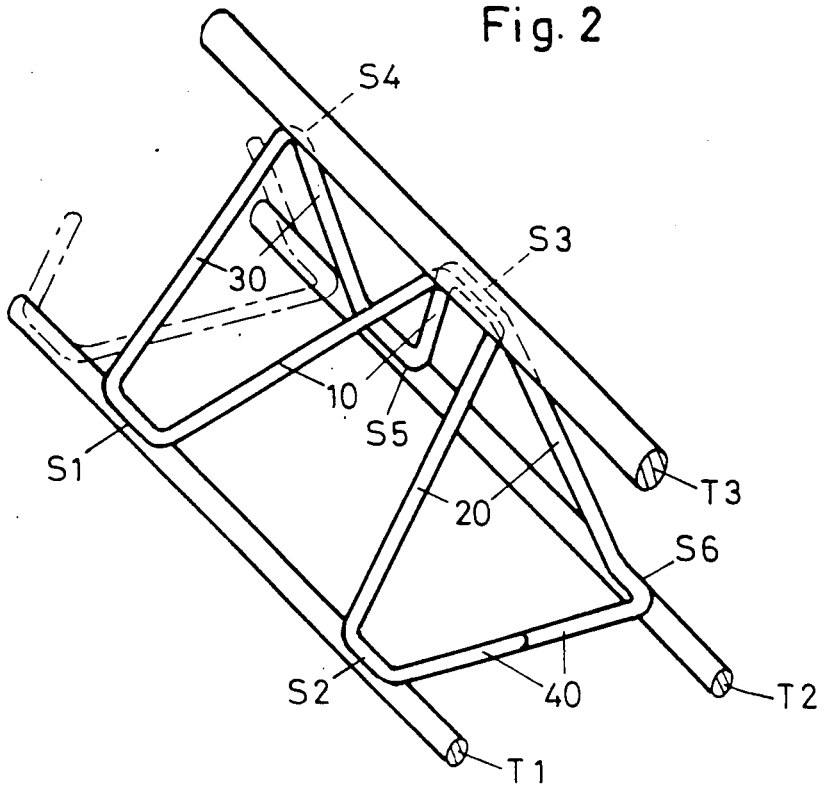
FIG. 2 is a perspective view of the elements in accordance with the invention.

According to the invention, as shown in FIG. 2, there are likewise two triangular wire polygons 10, 20, similar to those described in the previous example, which are welded to the top bar T3 at a common welding location S3. However, while wire polygon 20 is provided with a strut 40 connecting the two lower rods T1, T2, a further triangular wire polygon 30 is attached to the other polygon 10, but without a strut connecting the two lower rods T1, T2. The necessary strut between the lower rods T1, T2 is formed by the succeeding polygon, indicated in dot-dash lines.

An obvious significant advantage in producing the lattice girder with the type of stiffening elements in FIG. 2 is that such a stiffening element can be produced in one piece with one welding location 41, so that, in contrast to the prior art structure shown in FIG. 1, it is unnecessary to stock three different elements.

Load trials on test girders of the known and the new construction type have shown that, with support at 1.5 m distances and pressure between the connecting elements according to FIG. 1, a load of 44.4 kN produced a deformation of 80 mm. With stiffening elements according to the present invention, a load of 51.5 kN produced deformation of 82 mm.

Similar measurements led to similar results, but with the load over the welding location on the top rod, namely 50.6 kN for a deformation of 80 mm in the case of the prior art structure and 54.2 kN for a deformation of 81 mm in the case of the applicants' stiffening element.

This means that, for identical local requirements, a top rod of only 26 or 28 mm need be used for a given bending force, instead of a top rod of 30 mm. In addition to this saving in materials, there is the savings in materials for the stiffening element itself because two connecting struts between the lower rods, namely, the strut on wire polygon 1 and the strut of polygon 3 parallel to it, are no longer required. This saving in materials, with 10% to 15% greater stability, can play a significant role in underground drift construction.

What is claimed is:

1. Stiffening element for three-rod girder for underground shaft construction, said three-rod girder comprising two base rods (T1, T2) and a top rod (T3), each of said rods forming an edge of a triangular prism, said stiffening element being constituted by three portions each forming a triangular wire polygon (10, 20, 30), said portions being formed from one piece, two of said wire polygons (10, 20) forming the side edges of a four-sided wire pyramid having a tip which is welded to said top rod (T3) and lower points welded to said two base rods (T1, T2), a third, one (30) of said wire polygons being straight and defining a plane which is perpendicular to the three rods (T1, T2, T3), and only the wire polygon (20) which is most remote from said straight polygon (30) comprising a strut (40) connecting said two base rods (T1, T2).

2. Element in accordance with patent claim 1, wherein said three wire polygons (10, 20, 30) form a single wire loop.

* * * * *